United States Patent [19]

Malt

[11] 4,244,659

[45] Jan. 13, 1981

[54] KEYBOARD ARRANGEMENT

[76] Inventor: Lillian G. Malt, Quirral House, Thursley, Surrey, England

[21] Appl. No.: 911,251

[22] Filed: May 31, 1978

[30] Foreign Application Priority Data

Jun. 1, 1977 [GB] United Kingdom ..... 23308/77

[51] Int. Cl.[3] ..... B41J 5/10

[52] U.S. Cl. ..... 400/486; 400/488; 400/489

[58] Field of Search ..... 400/472, 482, 486, 487, 400/488, 489

[56] References Cited

U.S. PATENT DOCUMENTS

| | | | |
|---|---|---|---|
| 1,395,049 | 10/1921 | McNamara | 400/482 |
| 2,040,248 | 5/1936 | Dvorak et al. | 400/486 |
| 3,805,939 | 4/1974 | Ross | 400/489 X |
| 3,929,216 | 12/1975 | Einbinder | 400/486 X |
| 3,945,482 | 3/1976 | Einbinder | 400/486 |

FOREIGN PATENT DOCUMENTS

| | | | |
|---|---|---|---|
| 1016993 | 1/1966 | United Kingdom | 400/489 |

*Primary Examiner*—Ernest T. Wright, Jr.

*Attorney, Agent, or Firm*—Pollock, Vande Sande & Priddy

[57] ABSTRACT

A typewriter keyboard arranged to take into account the frequency of occurrence of letters so that the keys for the most frequently occurring letters are positioned for easiest operation by the typist. Account is also taken of the frequency of occurrence of consecutive letters so that one finger or thumb will not have to operate different keys in rapid succession. The keyboard further includes keys to form letters or functional operations operable by the thumb. In one embodiment, two pluralities of keys are provided for operation by the fingers of the left and right hands, respectively, and two further pluralities of keys are provided for operation by the right and left thumbs, respectively.Each of the four pluralities of keys is arranged on a surface which is concave in two orthogonal directions.

14 Claims, 7 Drawing Figures

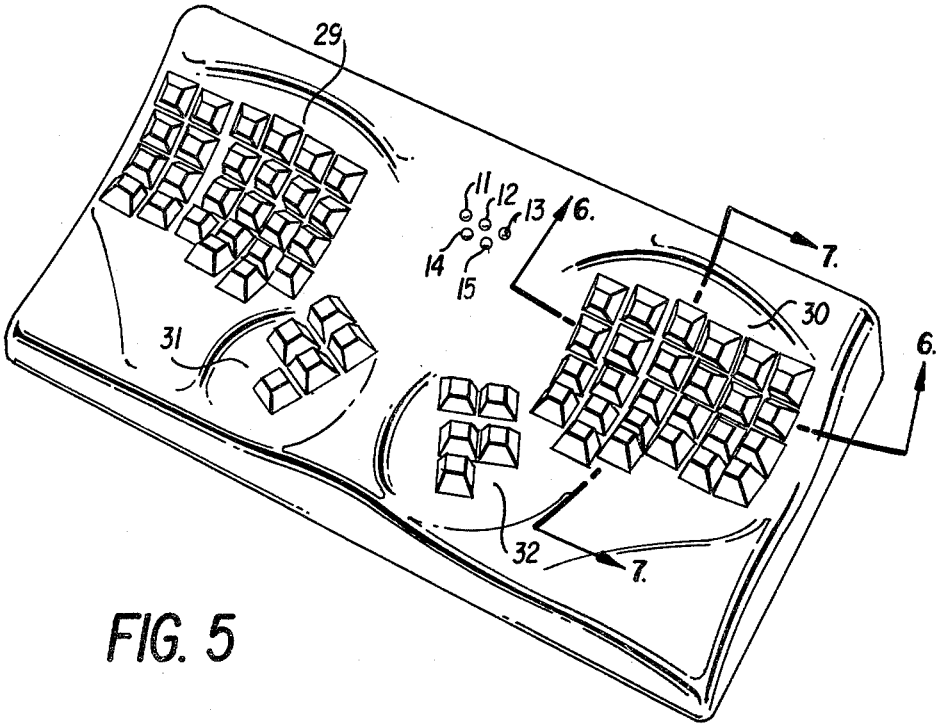
FIG. 5
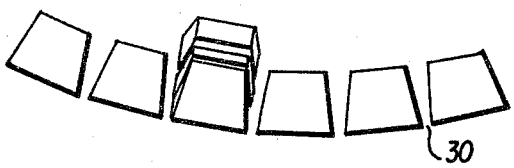
FIG. 6
FIG. 7
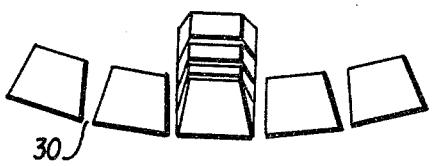

KEYBOARD ARRANGEMENT

BACKGROUND OF THE INVENTION

This invention relates to keyboards for typewriters and other information input devices in which keys are depressed to cause the recording of individual letters, numbers and other symbols and to effect functional operation of the input device.

The standard typewriter keyboard, known as qwerty from the keys along the row above the centre row reading from the left has been in use for many years, but is not entirely satisfactory for high speed typing because frequently used letters are operated by weaker fingers or fingers in awkward positions, and frequently occurring consecutive letters are operated by the same finger which must move from one key to the next between operating the letters. For this reason, normal typing speeds do not approach dictation speeds of, say, 100 wpm.

U.S. Pat. Nos. 3,929,216 and 3,945,482 disclose alternative designs of keyboards in which the letters and numbers are arranged in a different manner from the standard qwerty keyboard. Those patents disclose keys for the right and left hand which are separated from each other so that the typist can have the forearms extending parallel to each other with the fingers resting at their normal positions on the keys rather than inclined towards each other as with the standard keyboard. These prior art keyboards also disclose keys for depression by the thumbs for operating letters as well as the functional keys such as the space bar on the conventional keyboard. Between the spaced sets of keys for the two hands are arranged special code keys.

It is an object of the invention to provide an improved keyboard layout in which the keys are arranged so that the most frequently used symbols are operated by the strongest fingers, and the most frequently occurring consecutive symbols are operated by different fingers in order to provide high speed operation.

SUMMARY OF THE INVENTION

In one aspect of the invention an improved keyboard is provided by arranging the keys for two-handed operation generally in a plurality of rows, the fingers normally being rested on a central row. In this central row, the letters A, N, I, S and F are operated by the little finger, ring finger, middle finger, index finger, and index finger extended of the left hand respectively. The central row for the right hand contains keys to operate the letters, D, T, H, O and R for operation by the index finger extended, the index finger, the middle finger, the ring finger and the little finger respectively.

There are preferably three rows of keys for the letter symbols, the upper row for the left hand containing keys for the letters, Q, P, Y, C and B to be operated respectively by the little finger, ring finger, middle finger, index finger and index finger extended of the left hand respectively extended further from the typist. In the row below the central row, keys to operate the letters J and G are provided for operation by the middle and index fingers respectively. Keys to operate the letter E and the symbol full stop (period) are provided for operation by the thumb in its normal and extended positions respectively. The upper row for the right hand contains keys to operate the letters V, M, U, Z and X to be operated by the same fingers respectively. The lower row contain keys to operate the letters W, K and L to be operated by the index finger, middle finger and little finger respectively. Keys to operate the spacing and carriage-return function are provided for operation by the right thumb in its normal and extended positions respectively.

According to another aspect of the invention there is provided a keyboard for operation by a single hand, arranged generally in a plurality of rows. Along a central row, which is the normal position for the finger tips, keys to operate the letters S, A, T, E, H and N are provided for operation by the index finger extended, the index finger, the middle finger, the ring finger, the little finger and the little finger extended respectively. There are preferably five rows. In the rows above the central row, keys to operate the letters J, F, D, O, L and R are provided for operation by the index finger extended, the index finger, the middle finger, the ring finger, the little finger and the little finger extended respectively. In the top row, keys to operate the letters X, G, M, P and B are provided for operation by the index finger extended, the index finger, the middle finger, the ring finger and little finger extended respectively. In the row below the central row, keys to operate the letters Z, Y, C, K and V are provided for operation by the index finger extended, the index finger, the middle finger, the ring finger and the little finger extended respectively. In the bottom row, keys to operate the letters Q and W are provided for operation by the index finger and middle finger respectively. Keys are also provided for operation by the thumb, a space key for operation by the thumb in its normal position, and keys to operate the letters I, U and the carriage-return function by the thumb when extended.

DETAILED DESCRIPTION OF THE INVENTION

Examples of the invention will now be described with reference to the accompanying drawing, in which:

FIG. 5 shows a perspective view of a keyboard for use by both hands;

FIG. 6 shows a view along line 6—6 of FIG. 5; and

FIG. 7 shows a view along line 7—7 of FIG. 5.

In order to provide high speed operation of a keyboard, it is essential to reduce the number of times a single finger is used twice in succession. When the single finger is used twice in succession, it is preferable to reduce the number of times it has to move from one row to a non-adjacent row as this movement will clearly take longer than movement between adjacent rows. An analysis has been made of nearly six million key strokes typing English lanugage text, comparing the number of times a single finger is used twice in succession and the number of times a single finger has to move between non-adjacent rows on the standard qwerty keyboard, a keyboard of Dvorak (see U.S. Pat. No. 2,040,248), and the keyboard shown in FIG. 2 of the present specification. It was found that the standard keyboard had about two hundred and seventy-five thousand successive single finger uses in the analysis, the Dvorak keyboard about eighty-four thousand, and the present keyboard of FIG. 2 twenty-five thousand, a reduction of eleven times compared to the standard keyboard. An even greater reduction was found in the analysis of the keyboards for movement of a single finger between non-adjacent rows, the standard keyboard having eighty-two thousand, the Dvorak keyboard three thousand five hundred, and the present keyboard of FIG. 2 three hundred and twenty-one.

The keyboard shown in FIGS. 1, 2 and 5 to 7 has the keys arranged in separate groups for the fingers of the two hands, and with further separate groups for operation by the two thumbs. The finger groups are separated by a space equal to the length of a row of five keys. When the typist sits with the index fingers on a key in the next-to-innermost column in the two groups, the forearms are parallel. This is a more comfortable position than with the forearms inclined towards each other towards the hands as with the conventional keyboard.

Each finger group is arranged in approximate rows, although the rows are not exactly straight in order to accommodate the different lengths of the fingers.

Each finger group has six columns and five rows. In the rest position on the keyboard of FIGS. 1, the finger tips rest lightly on the center four keys in the center row, that is A, N, I and S on the left hand group, and T, H, O and R on the right hand group. The left hand thumb rests lightly on the key for E, and the right hand thumb on the space key. The keys for F and D are also arranged in the center row, for operation by the extended index finger of the left and right hand respectively. These are the essential keys which form the arrangement of my invention.

Figure 1:
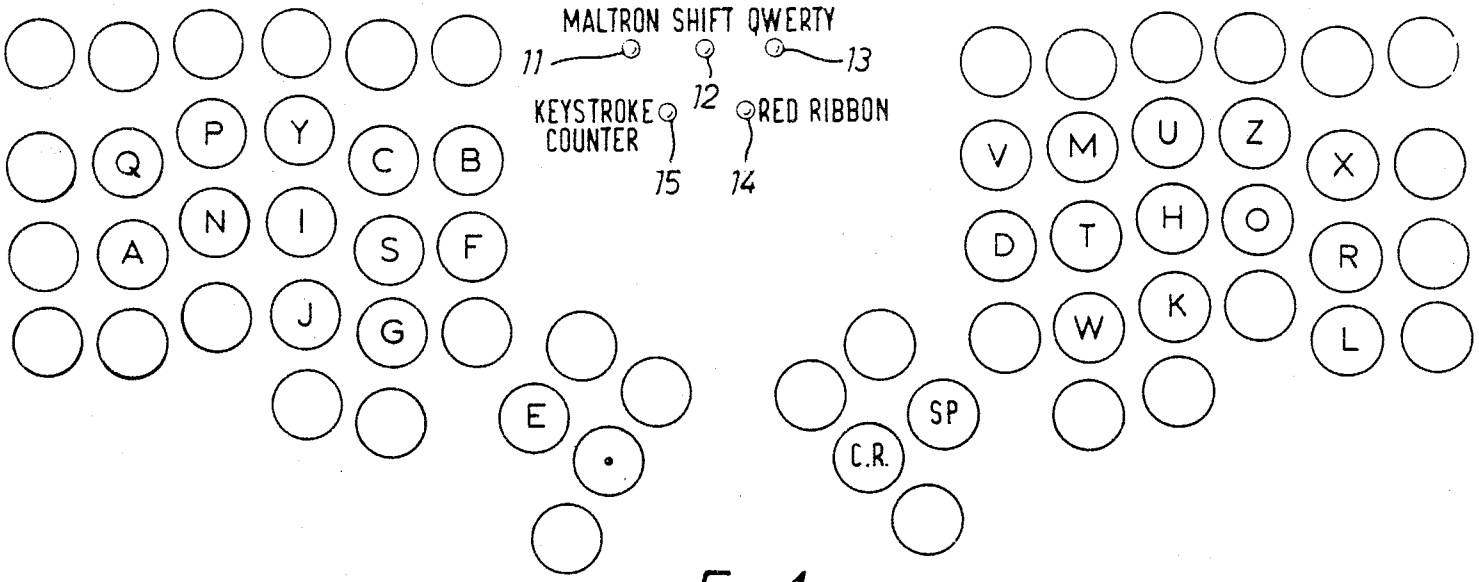
FIG. 1 shows a two-handed keyboard according to the invention showing the characters and functions to be operated by certain keys of the keyboard in order to provide higher speed operation.
Figure 2:
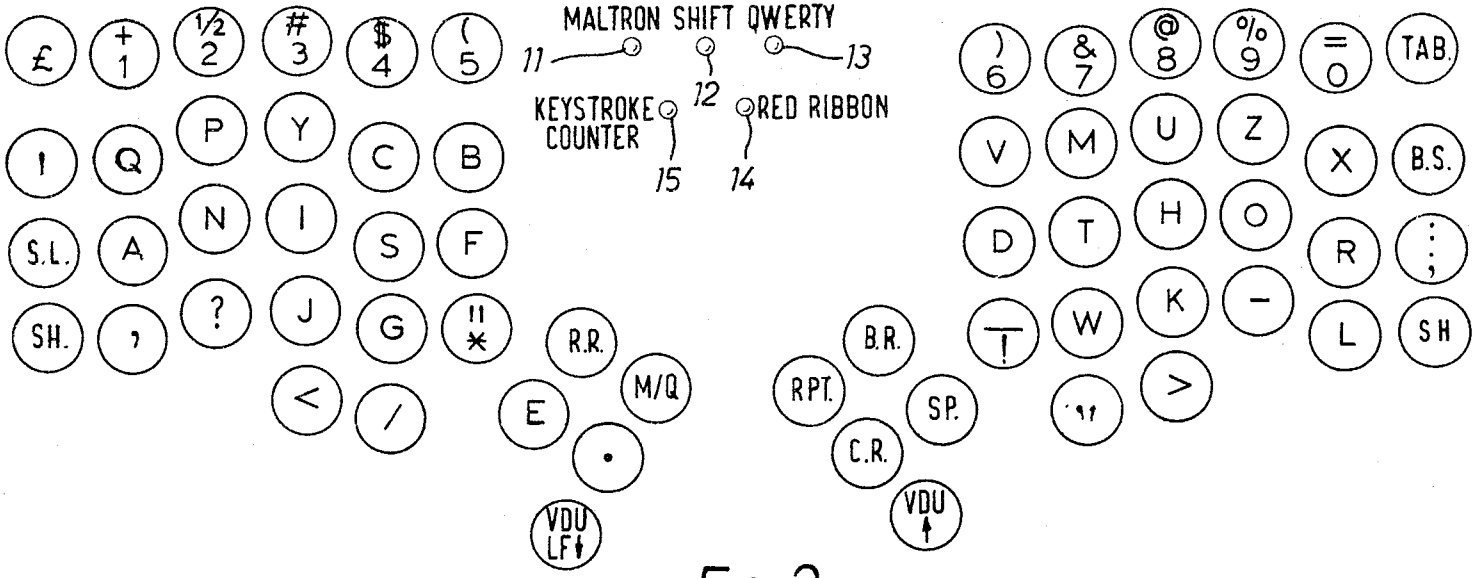
FIG. 2 shows the keyboard of FIG. 1 showing the characters or functions to be operated by the other keys of the keyboard besides those shown in FIG. 1, the arrangement of these keys being less important to provide the higher speed operation.

FIG. 1 shows a preferred key arrangement I have chosen from my analysis of individual letters and sequences of letters occurring in English text. FIG. 2 shows the complete keyboard including the letters and functional operations of FIG. 1 together with the remaining symbols and functional operations to make up the complete keyboard. In the description below, I have referred to the important keys as shown in FIG. 1. and the non-important keys added to the keyboard in FIG. 2.

In the left hand group of keys, the top row contains non-important symbols throughout, the symbols reading from the left being £, 1, 2, 3, 4 and 5 and the second to sixth keys representing in the shift position +, ½, the number symbol, $ and (. In the second row, there is the non-important apostrophe symbol, and the important letters Q, P, Y, C and B. In the third row, on which the finger tips rest, is, reading from the left, the non-important shift lock key, and the important letters, A, N, I, S and F. In the next row, there is, reading from the left, the non-important shift key, the comma key and the ? key, the important keys J and G and the non-important key denoting an asterisk in lower case and inverted commas in the upper case. In the bottom row, there are the non-important keys representing "is greater than" in the fourth column and an oblique stroke in the fifth column.

In the left hand thumb group of keys, there are five keys arranged in three rows. In the center row there is the important key for E under the normal position of the thumb and the important full stop (period) key in the extended position of the thumb closer to the center of the keyboard. In the row above, reading from the left, there are the non-important keys to operate a red ribbon and the margin release. In the bottom row there is non-important key to operate a video display unit if such should be used with the keyboard.

In the right hand group of finger keys, the first five keys reading from the left operate the numbers 6, 7, 8, 9, 0 in the lower case and the symbols), ampersand, @, % and = in the upper case, and the sixth key is the tabulator key. In the second row there are the important symbols V, M, U, Z, and X and the non-important backspace key. In the center row, above which the right hand finger tips are poised at rest, there are the important keys for D, T, H, O and R and the non-important keys for; and the : symbol in the shift position. In the next row, there is the non-important key for ! symbol in lower case and _ in upper case, the important keys for the letters W, and K, the non-important keys for the hyphen (-) symbol, the important key for L and a non-important key repeating the shift operation. In the lowest row, there are non-important keys for the " symbol in the second column and the 'is greater than' symbol in the third column.

There are five keys for operation by the right thumb, arranged in three rows. In the center row, there is the 'carriage return' key for operation by the extended thumb and the space key for operation by the thumb when not extended, both these keys being important. In the top row, there are the non-important keys to cause a repeat of the last-depressed key, and a key to bring a black ribbon into operation. In the bottom row, there is a non-important key for operation of a video display unit if used with the keyboard.

In the space between the groups of finger keys there are provided indicator lamps in two rows. In the top row, the outer lamps 11 and 13 are selectively illuminated to indicate whether the keys will operate the symbol or function marked on the keys as shown in FIG. 2, or whether they will operate the symbol or function of the corresponding key on the qwerty keyboard. The lamp 11 is illuminated in the first instance, and the lamp 13 in the second. The center lamp 12 in the top row indicates wheter the keyboard is in its 'shift' position, in which upper case letters are typed and the symbols shown in the upper position on the non-letter keys. Otherwise, lower case letters and the symbols shown in the lower part of the keys will be typed. In the lower row of indicator lamps, the right hand lamp 14 is illuminated when the red ribbon is being used for typing. The lamp 15 is illuminated when a key stroke counter is connected to the keyboard, for counting the number of times each key is depressed.

In place of or in addition to the lamps 11–15 between the groups of finger keys, further keys may be provided between the columns of keys for operation by the extended index fingers of the two hands. These may be used for controlling functions of the information processing machine, or could be arranged as a further set of number keys arranged for operation by the right hand for example as in a calculator keyboard.

The rows of keys may be arranged as in a conventional keyboard, that is with the keys of a row at uniform height but with the height of individual rows increasing from the front to the back, or the individual finger groups and thumb groups may be arranged on a concave surface, the columns and rows each being concave. Ergonomic considerations will control the exact shape of the keyboard.

Figure 3:
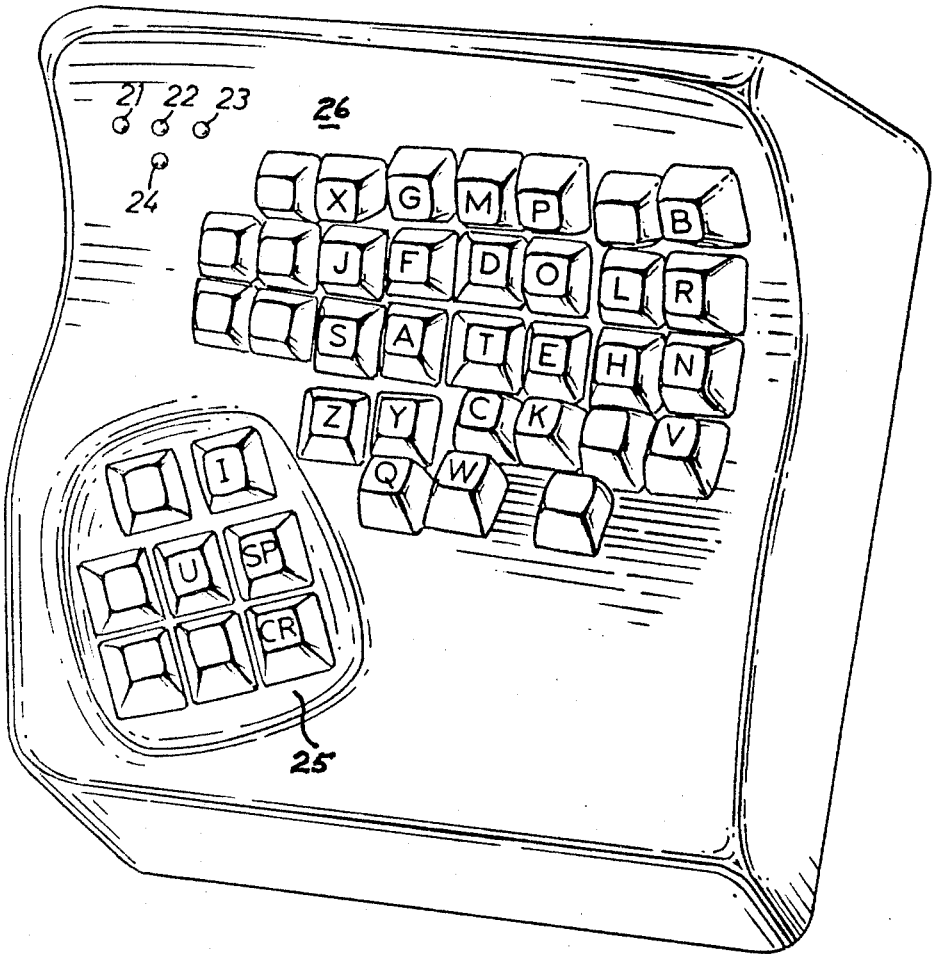
FIG. 3 shows a keyboard for use by the right hand only showing the arrangement of certain keys in order to provide higher speed operation.
Figure 4:
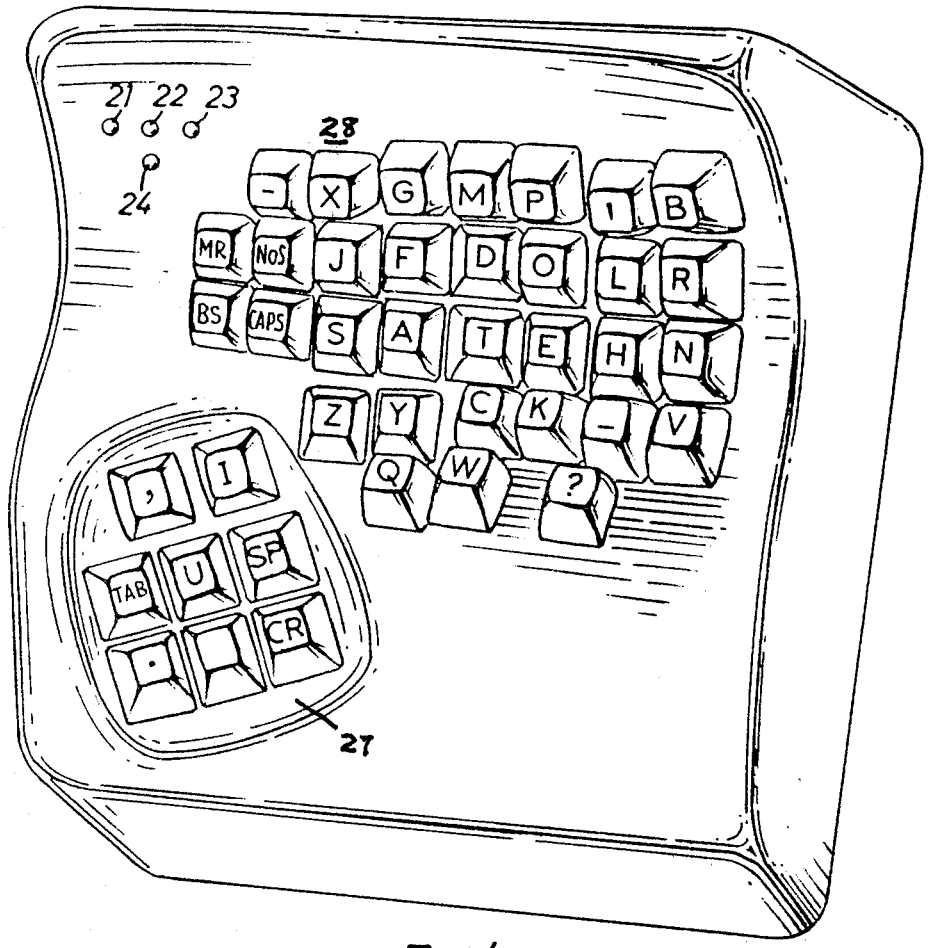
FIG. 4 shows the keyboard of FIG. 3 also showing the characters or functions operated by the remaining, less important, keys.

FIGS. 3 and 4 show a single handed keyboard for operation by the right hand, in which the keys are arranged in a finger group of five rows and a thumb group of three rows. The rows and columns in both groups are concave. In FIG. 3, the concave portions are designated as 25 and 26, and in FIG. 4 as 27 and 28. FIG. 3 shows the arrangement of the keys which are important to achieve high speed typing, and FIG. 4 shows the additional keys which are not so important to achieve high speeds.

Reading from the left, the top row contains the non-important hyphen symbol key, the important keys for X, G, M and P, the non-important apostrophe key and the important key for B. In the second row there are the non-important margin release and number shift key, and the important keys for J, F, D, O, L and R. In the center row, there are the non-important back-space and capital-shift keys, and the important keys for S, A, T, E, H and N. When the hand is in its rest position, the finger tips are poised above the keys for A, T, E and H of this row. In the next row, there are the important keys for Z, Y, C and K, the non-important underlining symbol key and the important key for V. In the lowest row, there are the important keys for Q and W, and the non-important ? symbol key. The rows are aligned so that the keys for G, F, A, Y and Q are aligned in a single column, the key for W being in the next column to the right, and the ? symbol key being in the column containing the apostrophe symbol, the letters L and H and the underlining symbol.

The thumb keys are arranged in three rows in a separate concave formation. Reading from the left, the top row contains the non-important comma symbol and the important I symbol. In the second row, there is the non-important tabulator key, the important U symbol and the important space key. In the lowest row, there is the non-important full stop (period) key, a non-important key with no symbol or function alloted and the important carriage return key.

To the left of the top row of keys in the finger group, are arranged a series of indicator lamps, the lamp 21 indicating the normal lower case operation, the lamp 22 indicating the capital shift operation, and the lamp 23 indicating the number shift operation. The lamp 24 is arranged below the other lamps and indicates the key stroke counter operation.

The number shift operation causes numbers to be typed by the keys of the keyboard, but these numbers are not indicated on the keys and can be arranged in any convenient and preferably ergonomic arrangement.

FIGS. 5 to 7 show perspective views of a two-handed keyboard in which the keys are arranged for high speed operation. The right and left hand arrangements of the keys correspond in number to those shown in FIGS. 1 and 2, as illustrated; however, provision of keys of the number shown in FIGS. 3 and 4 also is within the scope of the present invention. The keys to be actuated by the fingers are arranged across concave surfaces 29 and 30. FIGS. 6 and 7 illustrate how the rows and columns of the keys are concave in two orthogonal directions, for both hands. The keys to be actuated by the thumbs are arranged over concave surfaces 31 and 32, so that the rows and columns of thumb keys are also concave in two directions, in a manner similar to that shown in FIGS. 6 and 7 for the finger keys.

I have described a two-handed keyboard and a single-handed keyboard in which the important keys are arranged for high speed operation. With these arrangements of important keys, it is possible to type at dictation speeds, so that the keyboard can be connected to a video display unit to provide immediate display of dictated information. The keyboards may also be connected to a memory such as a magnetic tape casette and the information contained in the memory can be processed, for example to correct certain words in the dictation or to justify individual lines, the information then being fed from the processing unit to a high-speed typewriter.

What is claimed is:

1. An imput keyboard for the transfer of information to a machine by a human operator comprising:

a plurality of keys arranged for operation by the operator's fingers on both hands in at least three rows, the center of said three rows containing in order from the left as viewed by the operator keys to operate at least the letters A, N, I, S, F, D, T, H, O and R, the upper row of said three rows containing in order from the left as viewed by the operator keys to operate at least the letters Q, P, Y, C, B, V, M, U, Z and X, the lower of said three rows containing in in order from the left as viewed by the operator keys to operate at least the letters J, G, W, K, and L, and a plurality of keys arranged for operation by the operator's thumbs, keys for E and the full stop (period) symbol being arranged for operation by the operator's left thumb and keys for the carriage return and spacing operations being arranged for operation by the operator's right thumb.

2. A keyboard as claimed in claim 1, wherein the keys for the full stop (period) and the carriage return operation are arranged on the sides of the keys for E and the spacing operation remote from the keys for operation by the operator's fingers.

3. A keyboard as claimed in claim 1, wherein at least some of the keys for operation by the operator's left hand are arranged over a first concave surface and at least some of the keys for operation by the operator's right hand are arranged over a second, separate, concave surface.

4. A keyboard as claimed in claim 3, wherein for each hand the keys for operation by the thumb are arranged over a concave surface separate from that over which the keys for operation by the fingers are arranged.

5. A keyboard as claimed in claim 3, wherein said surfaces are concave in two directions.

6. An input keyboard for the transfer of information to a machine by a human operator comprising:

a plurality of keys arranged for operation by the operator's fingers on one hand in at least five rows, and a second plurality of keys arranged for operation by the operator's thumb of said one hand, so that the operator can arrange the fingers of said one hand on the keys of one of said rows and the thumb of said one hand on a key of said second plurality of keys, the top row of said five rows containing in order from the side of the keyboard adjacent the little finger of said one hand when arranged as above at least keys to operate the letters B, P, M, G and X, the next-to-top row of said five rows containing in order from the side of the keyboard adjacent the little finger of said one hand when arranged as above at least keys to operate the letters R, L, O, D, F and J, the center row of said five rows containing in order from the side of the keyboard adjacent the little finger of said one hand when arranged as above at least keys to operate the letters N, H, E, T, A and S, the next-to-bottom of said five rows containing in order from the side of the keyboard adjacent the little finger of said one hand when arranged as above at least keys to operate the letters V, K, C, Y and Z, and the bottom of said five rows containing in order from the side of the keyboard adjacent the little finger of said one hand when arranged as above at least keys to operate the letters W and Q, the second plurality of keys including keys to operate the letters U and I, and the spacing and carriage return operations.

7. A keyboard as claimed in claim 6, wherein the keys to operate the letters I and U, and the carriage return operation are arranged to be operated by the thumb when extended further than when the thumb is positioned to operate the space key.

8. A keyboard as claimed in claim 6, wherein at least some of the keys are arranged over a concave surface.

9. A keyboard as claimed in claim 8, wherein said concave surface is concave in two directions.

10. A keyboard as claimed in claim 8, wherein the keys arranged for operation by the operator's fingers are arranged on a first concave surface and the keys arranged for operation by the operator's thumb are arranged on a second, separate, surface.

11. An input keyboard for the transfer of information to a machine by a human operator comprising:

a plurality of keys arranged for operation by the operator's fingers on both hands in a plurality of rows, the central row of said rows containing in order from the left as viewed by the operator keys to operate at least the letters A, N, I, S, F, D, T, H, O and R, and a plurality of keys including one for the letter E arranged for operation by the operator's thumbs.

12. An input keyboard for the transfer of information to a machine by a human operator comprising:

a plurality of keys arranged for operation by the operator's fingers on one hand in a plurality of rows, and a second plurality of keys arranged for operation by the operator's thumb of said one hand, so that the operator can arrange the fingers of said one hand on the keys of one of said rows and the thumb of said one hand on a key of said second plurality of keys, the central row of said rows containing in order from the side of the keyboard adjacent the little finger of said one hand when arranged as above at least keys to operate the letters N, H, E, T, A and S.

13. An input keyboard for the transfer of information to a machine by a human operator comprising:

first and second pluralities of keys each arranged in a plurality of rows for operation by the operator's fingers on the right and left hands respectively third and fourth pluralities of keys arranged for operation by the operator's right and left thumbs, respectively, the keys in each of said first through fourth pluralities of keys being arranged on four separate surfaces each concave in two orthogonal directions.

14. An input keyboard for the transfer of information to a machine by a human operator comprising:

a first plurality of keys arranged in a plurality of rows for operation by the operator's fingers on one hand, and a second plurality of keys arranged for operation by the operator's thumb of said one hand, so that the operator can arrange the fingers of said one hand on the keys of one of said rows and the thumb of said one hand on a key of said second plurality of keys, wherein the first plurality of keys is arranged on a surface concave in two orthogonal directions, and the second plurality of keys is arranged on a separate surface concave in two orthogonal directions.

* * * * *